US006973810B2

(12) United States Patent
Chen

(10) Patent No.: US 6,973,810 B2
(45) Date of Patent: Dec. 13, 2005

(54) TOOLBOX ROTARY LATCH

(75) Inventor: John Chen, Foothill Ranch, CA (US)

(73) Assignee: Ryadon, Inc., Foothill Ranch, CA (US)

( * ) Notice: Subject to any disclaimer, the term of this patent is extended or adjusted under 35 U.S.C. 154(b) by 0 days.

(21) Appl. No.: 10/452,417

(22) Filed: Jun. 2, 2003

(65) Prior Publication Data

US 2004/0239125 A1 Dec. 2, 2004

(51) Int. Cl.[7] ..... E05B 13/10

(52) U.S. Cl. ..... 70/208; 70/224; 70/221; 292/216; 292/210; 292/DIG. 31

(58) Field of Search ..... 292/216, 48, 96, 292/210, 240, DIG. 31; 70/208–209, 215–216, 70/224, 472, 221

(56) References Cited

U.S. PATENT DOCUMENTS

| | | | | |
|---|---|---|---|---|
| 3,371,511 A | | 3/1968 | Atkinson | |
| 3,782,141 A | | 1/1974 | Doerrfeld | |
| 4,438,964 A | | 3/1984 | Peters | |
| 4,911,487 A | * | 3/1990 | Rachocki | 292/216 |
| 4,951,486 A | | 8/1990 | Braun et al. | |
| 4,989,907 A | | 2/1991 | Edmonds et al. | |
| 5,042,853 A | * | 8/1991 | Gleason et al. | 292/216 |
| 5,069,491 A | * | 12/1991 | Weinerman et al. | 292/216 |
| 5,127,686 A | * | 7/1992 | Gleason et al. | 292/216 |
| 5,299,844 A | | 4/1994 | Gleason | |
| 5,439,260 A | * | 8/1995 | Weinerman et al. | 292/48 |
| 5,450,734 A | * | 9/1995 | Esaki et al. | 70/208 |
| 5,526,660 A | | 6/1996 | Bennett et al. | |
| 5,564,295 A | * | 10/1996 | Weinerman et al. | 70/208 |
| 5,586,458 A | | 12/1996 | Weinerman et al. | |
| 5,595,076 A | * | 1/1997 | Weinerman et al. | 70/208 |
| 5,884,948 A | * | 3/1999 | Weinerman et al. | 292/216 |
| 5,941,104 A | * | 8/1999 | Sadler | 292/216 |
| 5,984,383 A | | 11/1999 | Parikh et al. | |
| 6,039,363 A | * | 3/2000 | Sugimura et al. | 70/208 |
| 6,109,670 A | * | 8/2000 | Tomaszewski et al. | 292/216 |
| 6,247,732 B1 | * | 6/2001 | Alton | 292/216 |
| 6,264,254 B1 | * | 7/2001 | Siegfried et al. | 292/216 |

* cited by examiner

*Primary Examiner*—Brian E. Glessner
*Assistant Examiner*—Christopher Boswell
(74) *Attorney, Agent, or Firm*—Fulwider Patton Lee & Utecht

(57) ABSTRACT

A toolbox latch is disclosed having a pivoting handle mounted to a housing and mechanically linked to a pusher arm for setting in motion a series of linkages to trap and release a cooperating striker pin. The pusher arm rotates a swiveling trip lever when a turn-key member is first rotated into an unlocked position and the handle pulled in a pivoting motion away from the housing. The swiveling trip lever in turn rotates a rotating link member out of its locking position with a rotating lock lever, allowing a biasing spring on the rotating lock lever to rotate out of its trap position. The cooperating striker pin is thus freed from the trap position as the rotating link member disengages with the rotating lock lever and the latch is open. When the cooperating striker pin is brought back into proximity with the rotating lock lever as the toolbox is being closed, the force of the striker pin rotates the rotating lock lever back to the trap position, and a biasing spring returns the rotating link member back into engagement with the lock lever to prevent the lock lever from releasing the striker pin.

2 Claims, 4 Drawing Sheets

TOOLBOX ROTARY LATCH

BACKGROUND OF THE INVENTION

1. Field of the Invention

The present invention is directed generally to mechanical latching mechanisms, and more particularly to a toolbox rotary latch that opens to release a striker pin on a toolbox lid, and releasably traps the striker pin upon closing the toolbox, where the release of the striker pin is accomplished by actuating a pivoting handle mounted on the housing, and wherein the handle includes a turn-key member to lock and unlock the latch device.

2. Description of Related Art

Rotary latches are used in many applications such as doors, chests, cabinets, and the like where a lid or door needs to be held or locked in a closed position. Rotary latches are preferred in some applications because they can be designed to spring open upon latch release and may be slammed shut to a closed or locked position.

Rotary latches can be found in many existing applications. U.S. Pat. No. 6,502,871 to Malmanger issued Jan. 7, 2003 entitled "Rotary Latch System and Method" discloses a rotary latch for opening and closing a panel or door. U.S. Pat. No. 6,454,321 to Parikh issued Sep. 24, 2002 entitled "Rotary latch Operated By a T-Handle With Multiple Latch Actuator Connection Points" discloses a rotary latch with a T-handle that translates rotation to an actuating lever for triggering a trip pawl to release a latch jaw. U.S. Pat. No. 5,884,948 to Weinerman et al. issued Mar. 23, 1999 entitled "Rotary Latch and Lock" discloses another type of rotary latch. However, none of the latch mechanisms described in the references above are particularly suited for a toolbox.

The rotary latches of the prior art lack a simple but reliable activating latch or handle adapted for light weight applications such as toolboxes.

The rotary latches of the prior art lack a simple but reliable activating latch or handle adapted for light weight applications such as toolboxes.

SUMMARY OF THE INVENTION

The present invention is a rotary toolbox latch having a pivoting handle mounted on a housing with a first end disposed on a pivot pin and a second end freely pivotable thereabout. A return spring is preferably mounted on the pivot pin and cooperates with the handle to bias the handle into the housing cavity. The handle further includes a turn-key member that rotates within the handle's free end, and the turn-key member is mechanically linked to a pusher arm where rotation of the turn-key member results in a corresponding rotation of the pusher arm. As a result of the rotation of the turn-key member, the pusher arm has two positions—a "lock" position that does not engage a swiveling trip lever, and an "unlocked" position that engages the swiveling trip lever. When the turn-key member rotates the pusher arm into the unlocked position, an actuation/pivoting of the handle about the pivot pin rotates the free end of the handle away from the housing to linearly displace the mechanically linked pusher arm. The linear displacement of the pusher arm causes it to come into contact with and pivot a swiveling trip lever. The trip lever includes a gear tooth that, when rotated by the pusher arm, rotates a rotary link member mounted to the housing. The rotary link member is mounted on a cylindrical post and biased in a rotationally preferred direction against the rotation resulting from the gear tooth. The rotary link includes a drive tooth that engages the gear tooth of the trip lever to rotate the rotary link member against the biasing force. Adjacent the rotary link member is a rotating lock lever having a U-shaped latch catch that rotates from a trap position with the U-shaped latch catch opening against the surface of the housing to close the U-shaped opening, to an untrapped position where the U-shaped latch catch is rotated away from the housing to release the cooperating striker pin enclosed therein. The rotation of the rotary lock lever is achieved when the rotating link member is rotated by the swivel trip lever, thereby rotating a locking pawl on the rotating link member out of a notch on the rotating lock lever. With the locking pawl evacuated from the notch by the rotation of the rotating link lever, the rotating lock lever is free to rotate about its cylindrical post. Preferably, a biasing spring mounted on the cylindrical post springs open the U-shaped latch catch to the open position when the locking pawl is rotated out of the mating notch on the rotating lock lever.

DETAILED DESCRIPTION OF THE PREFERRED EMBODIMENTS

Figure 1:
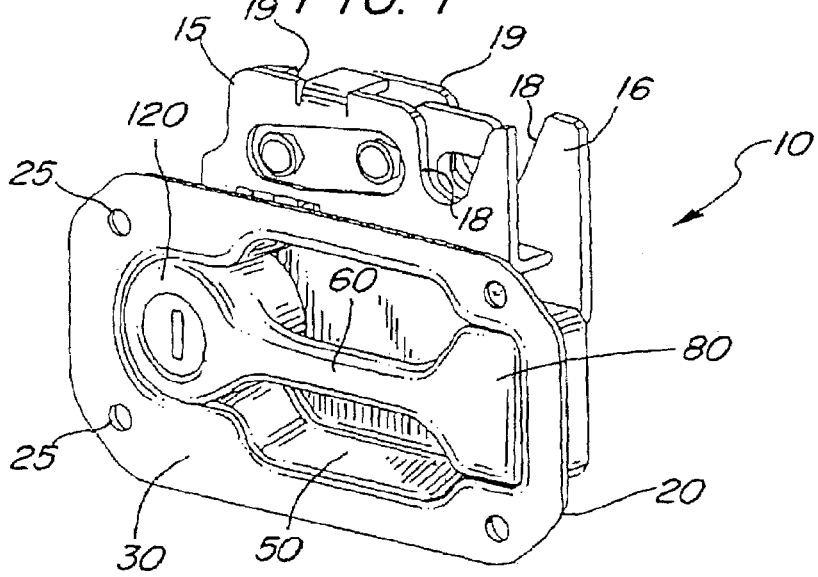
FIG. 1 is an elevated perspective view of one embodiment of the rotary latch of the present invention.
Figure 2:
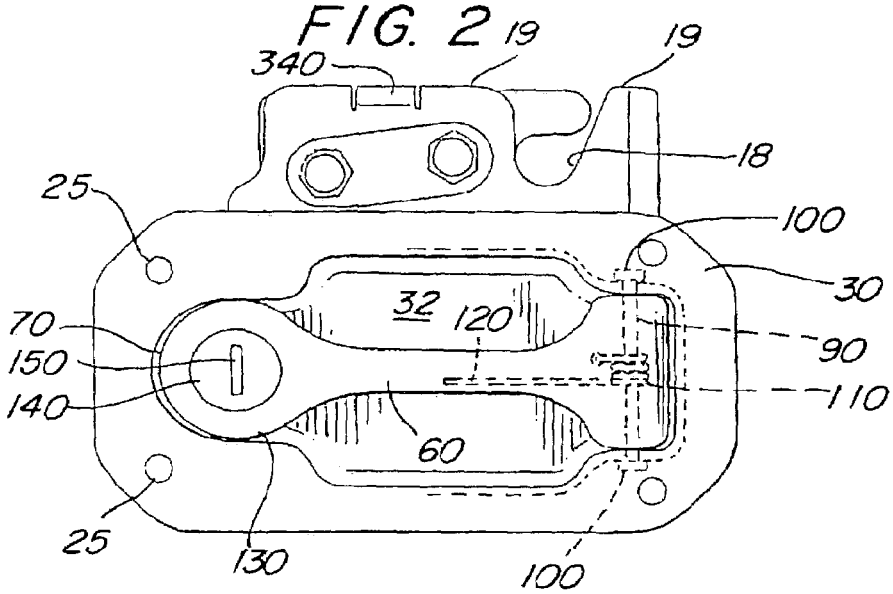
FIG. 2 is a front view of one embodiment of the rotary latch of FIG. 1.
Figure 3:
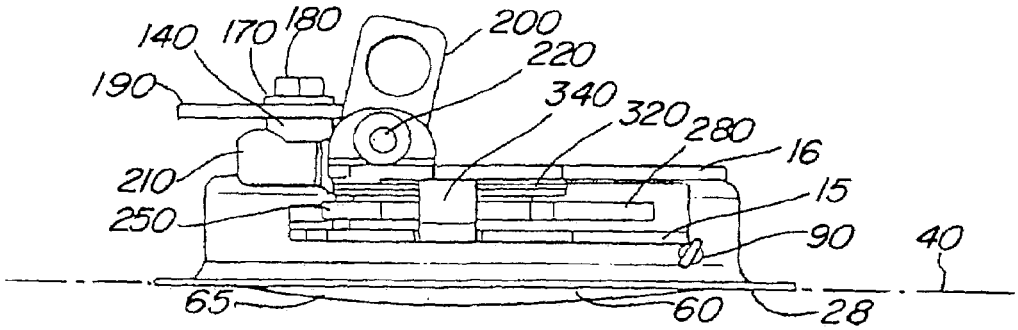
FIG. 3 is a top view of one embodiment of the rotary latch of FIG. 1.

FIGS. 1–11 illustrate a preferred embodiment of the rotary toolbox latch 10 of the present invention. A housing 20 is formed of a face plate 30 defining a first plane 40, and a recessed cavity 50 formed into the face plate 30 to accommodate a pivoting handle 60. A pair of parallel plates 15,16 rigidly mounted to the face plate further define the housing 20. The parallel plates 15, 16 each comprise an upper surface 19 with a U-shaped mouth 18 sized to receive a striker pin 23 of a cooperating lid or cover (not shown). The face plate 30 has a generally planar front surface 28 that recedes to a rear wall 32 to form the cavity 50. The cavity 50 is shaped to fit the ends of the handle 60 with a slight clearance 70 at each end, and expands around the central, narrowing portion of the handle 60 to permit grasping the handle with one's fingers. An arched middle portion 65 of the handle 60 preferably extends slightly outside the plane 40 defined by the face plate 30 as shown in FIG. 3.

The handle 60 is pivotally mounted at a base end 80 using a pivot pin 90 mounted in the housing 20. The pivot pin 90 is preferably fixed in the housing 20 at respective ends 100 that are seated in voids in the housing 20, and the handle 60 includes a traverse channel sized to receive the pivot pin 90 therein for rotational movement thereabout. A return spring 110 on the pivot pin 90 includes a first end 120 in contact with the handle 60 for biasing the handle into the cavity 50. Grasping the handle 60 about the central portion 65, a user can overcome the force of the return spring 110 and pivot the handle 60 away from the housing 20. Releasing the handle 60 allows the return spring 110 to return the handle 60 back to the housing 20. A plurality of holes 25 are spaced along the face plate 30 for attaching the latch 10 to its recipient apparatus, such as a toolbox.

The handle 60 includes a free end 120 opposite the base end 80 comprising an annular portion 130 surrounding a cylindrical turn-key member 140. The turn-key member 140 includes a keyhole 150 and requires a key (not shown) to rotate the turn-key member 140 within the free end 120 of the handle 60. Rotation of the key creates two positions for the turn-key member—an unlocked position and a locked position.

Figure 4:
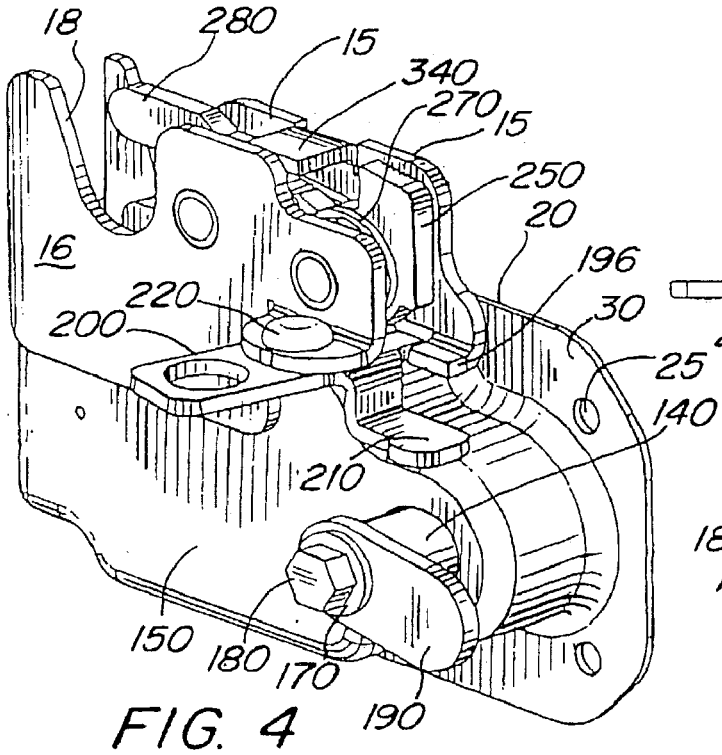
FIG. 4 is an elevated rear perspective view of one embodiment of the rotary latch of FIG. 1 with the turn-key member in the locked position.
Figure 7:
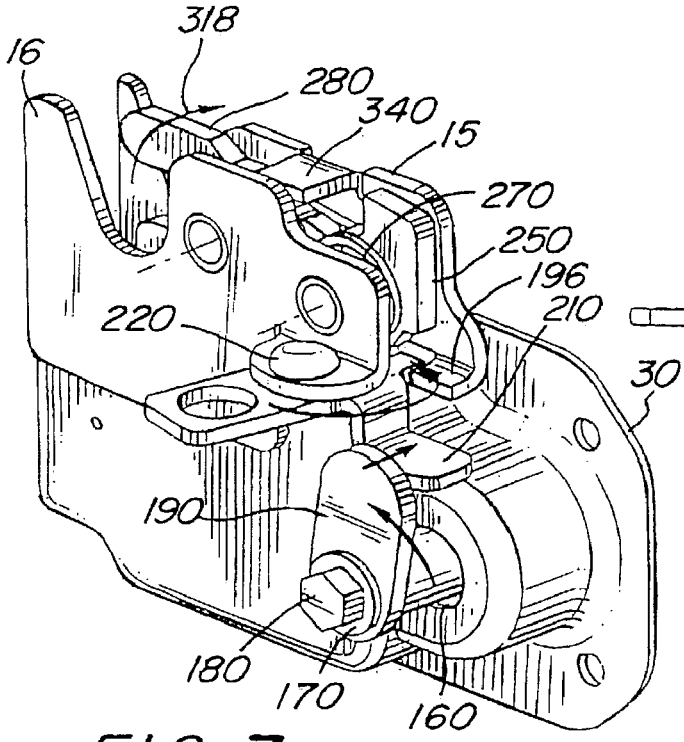
FIG. 7 is an elevated rear perspective view of the preferred embodiment of the rotary latch of FIG. 1 with the turn-key member in the unlocked position.

FIGS. 4-7 illustrate the actuation of the handle 60 and the cooperation of the turn-key member 140 to set in motion components that open the latching mechanism described more fully below. Behind the rear wall 150 of the housing 20, the cylindrical turn-key member 140 extends rearwardly through an aperture 160 in the housing's cavity 50. Secured to the end of the turn-key member 140 by a washer 170 and bolt 180 is a perpendicular pusher arm 190. In FIG. 4, the pusher arm is shown in a "three o'clock" position corresponding to a locked position. In FIG. 7, the pusher arm is shown in a "twelve o'clock" position corresponding to an unlocked position. Rotation of the turn-key member 140 via the associated key rotates the pusher arm 190 between the locked and unlocked positions. In other words, by rotating the key within the keyhole 150 of the turn-key member 140, the mechanical linkage of the pusher arm 190 and turn-key member 140 causes the pusher arm 190 to assume either the locked or unlocked positions as shown in FIGS. 4 and 7, respectively.

Figure 5:
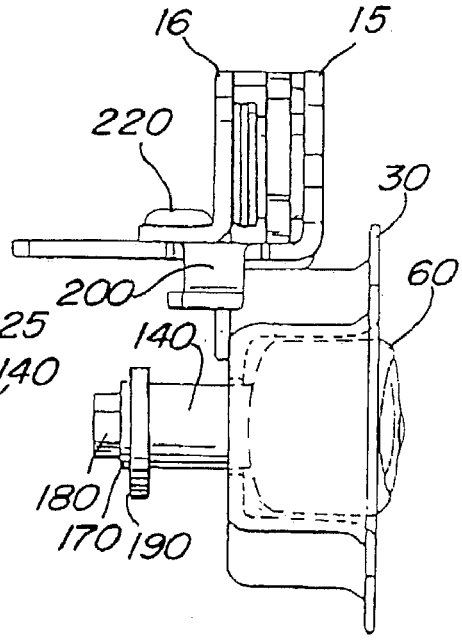
FIG. 5 is a left side view, partially in shadow, of one embodiment of the rotary latch of FIG. 1 with the handle retracted into the housing.
Figure 6:
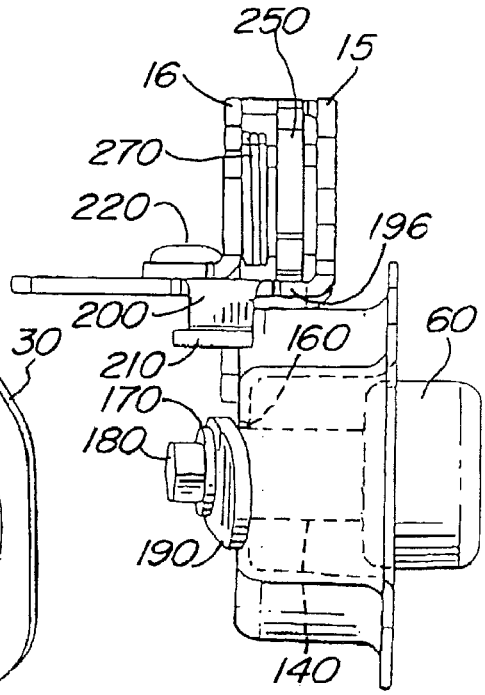
FIG. 6 is a left side view, partially in shadow, of one embodiment of the rotary latch of FIG. 1 with the handle deployed in an extended position.

As the handle 60 is pivoted away from the housing 20 (FIG. 6), the turn-key member 140 is withdrawn into the cavity 50 of the housing 20, and pusher arm 190 is translated toward the housing as shown in FIGS. 5 and 6. The motion of the handle 60 is created by the grasping of the handle 60 about the middle portion 65 and pulling the handle against the biasing force of the return spring 110 until the pusher arm comes in contact with the back wall of the housing 150, terminating the displacement of the handle 60. Releasing the handle 60 causes the return spring 110 to withdraw the handle back to its original position and returns the pusher arm 190 to its original position spaced from the rear wall 150. Two situations arise depending upon the position of the turn-key member 140. If the turn-key member 140 is rotated such that the pusher arm 190 takes the locked position shown in FIGS. 4 and 6, an actuation of the handle 60 fails to engage a rotating or swiveling trip lever 200 because the path of the pusher arm 190 does not cross the trip lever 200 in the locked position. In this case, a user can pull the handle 60 but cannot open the latching mechanism, highlighting the importance of the key position in the operation of the device.

Figure 8:
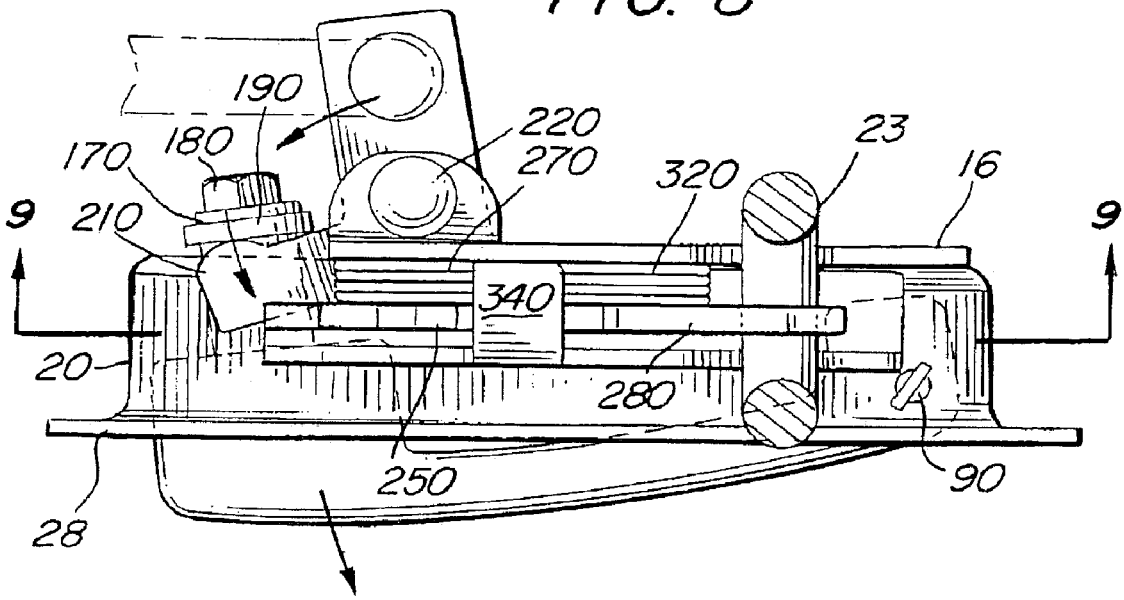
FIG. 8 is a top view of one embodiment of the rotary latch of FIG. 1, partially in shadow, showing the rotation of the trip lever with deployment of the handle.

If the turn-key member 140 is rotated such that the pusher arm 190 is in the unlocked position as shown in FIG. 7, then actuation of the handle 60 and the resulting displacement of the pusher arm 190 causes the pusher arm 190 to come into contact with a swiveling trip lever 200. Contact progresses to displacement as the handle 60 is pulled out of the cavity 50, and the force of the pusher arm 190 on the trip lever 200 causes the trip lever 200 to rotate counterclockwise when viewed from above (FIG. 8). The pusher arm 190 in the unlocked position during actuation of the handle 60 contacts a horizontal tab 210 of the trip lever 200, forcing the rotation of the trip lever. The trip lever 200 is suspended from the housing 20 at plate 16 by a rivet or fastener 220 that permits rotation of the trip lever 200 thereabout. Thus, the displacement of the horizontal tab 210 by the force of the pusher arm 190 is translated into a rotation of the trip lever 200 about its fastener 220.

The trip lever includes a tab that functions as a gear tooth 230 extending radially from the center of rotation (i.e., the fastener 220) and substantially perpendicular to the horizontal tab 210. A portion of the plate 15 forms a lip 196 that contacts the gear tooth 230 of the trip lever 200 to limit the rotation of the trip lever 200. The lip 196 prevents the trip lever 200 from rotating away from the housing 20 and further ensures that the horizontal tab 210 is always positioned in the path of the pusher arm 190 when the pusher arm 190 is in the unlocked position. Moreover, the gear tooth 230 is surrounded on the opposite side by a drive tooth 240 of a rotating link 250 described more fully below. A biasing spring 270 on the rotating link 250 forces the drive tooth 240 to capture the gear tooth 230 between the lip 196 and thus fix the position of the trip lever 200 in the absence of an external force.

Figure 10:
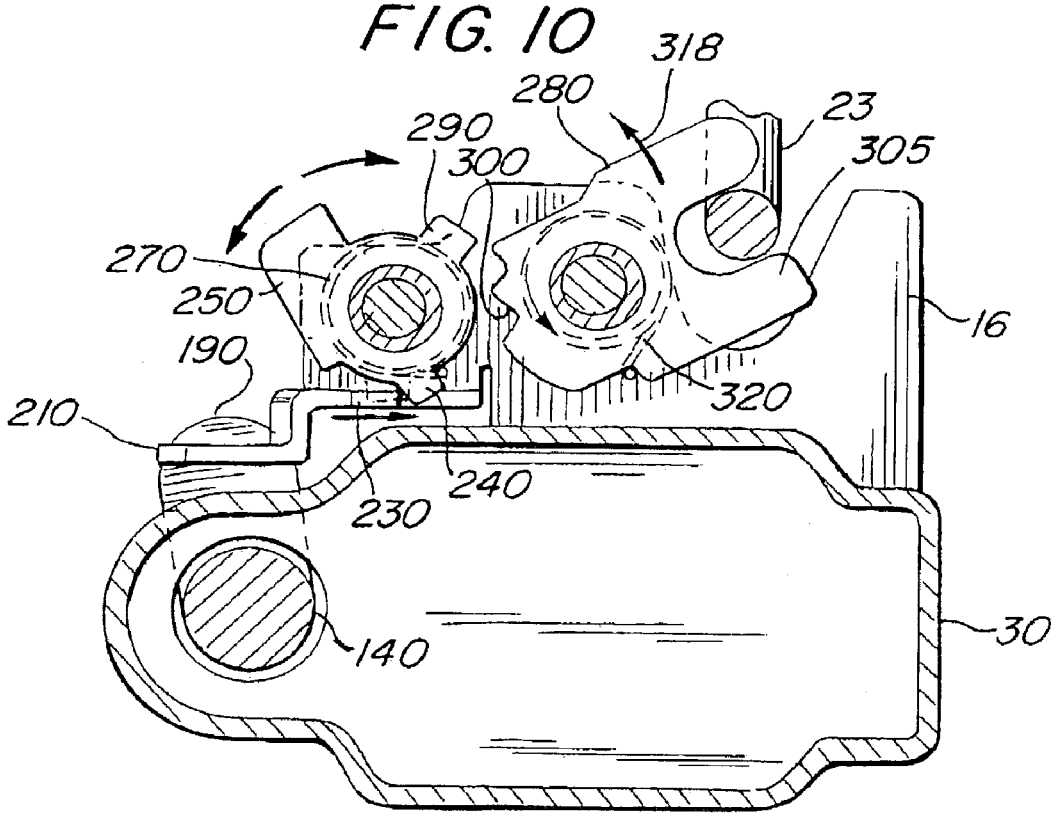
FIG. 10 is a cross-sectional view taken along section lines 9—9 of FIG. 8 of one embodiment of the rotary latch of FIG. 1 showing the relative rotation of the rotary link member and the rotating lock lever with actuation of the trip lever.
Figure 9:
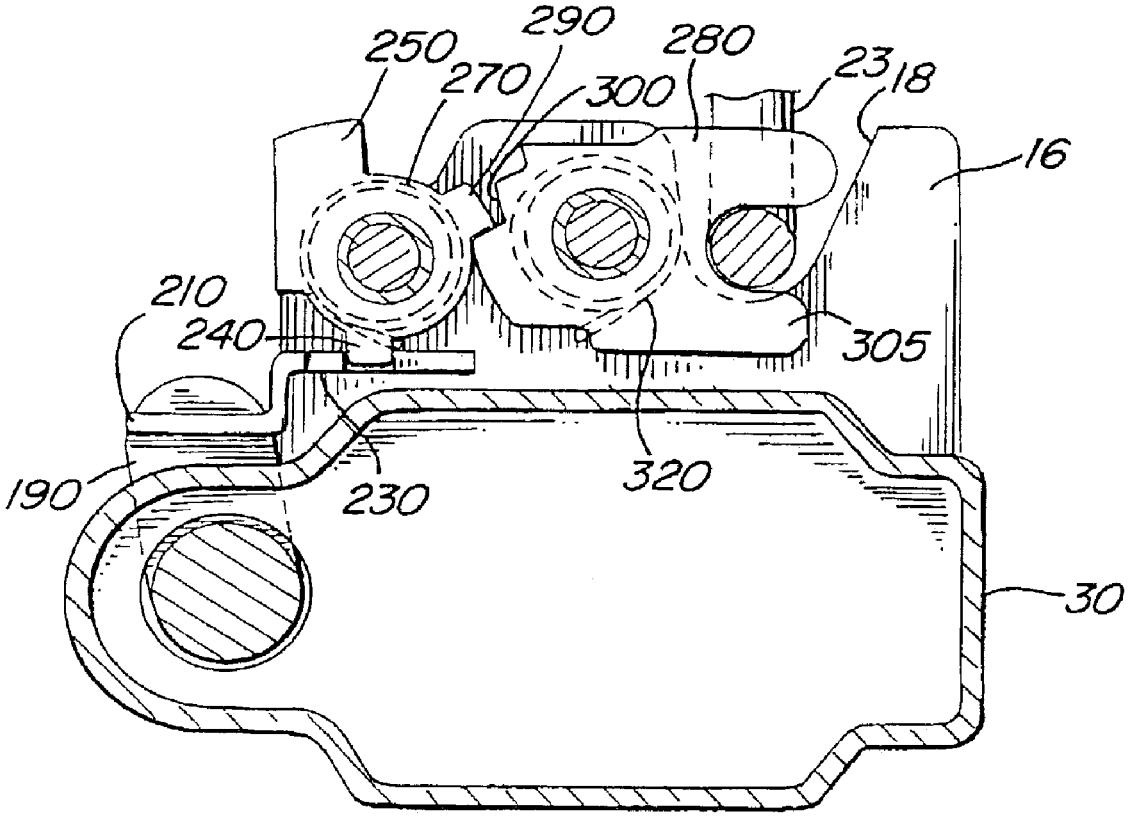
FIG. 9 is a cross-sectional view taken along section lines 9—9 of FIG. 8 of one embodiment of the rotary latch of FIG. 1.
Figure 11:
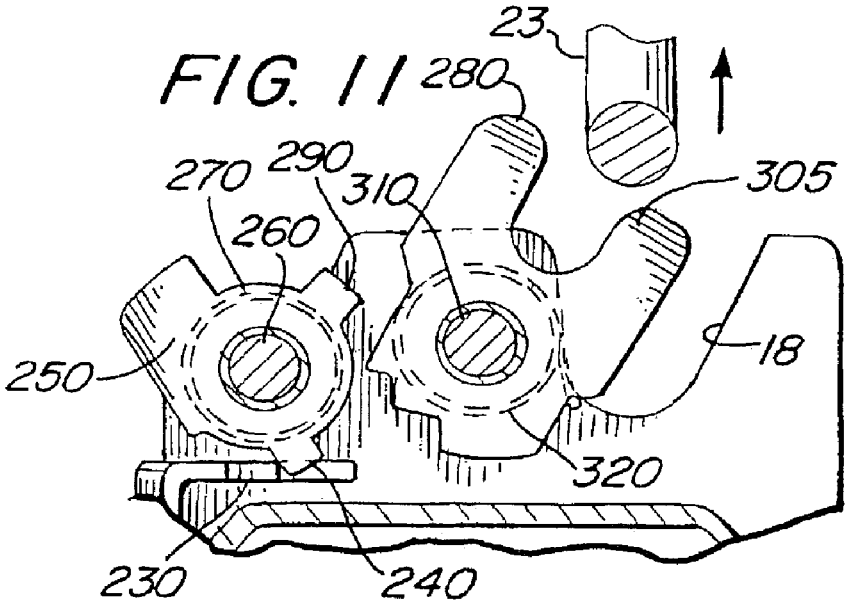
FIG. 11 is a partial cross-sectional view of the rotary latch of FIG. 1 taken along section lines 9—9 of FIG. 8 illustrating the release of the latch member with rotation of the link member and lock lever.

Rotation of the trip lever 200 caused by the pusher arm 190 results in the displacement of the gear tooth 230 of the trip lever 200 against the drive tooth 240 (FIGS. 9–11). The contact of the gear tooth 230 from the rotation of the trip lever 200 at the horizontal tab 210 pushes the drive tooth 240 linearly to the right as shown in FIG. 10. The force applied to the drive tooth 240 rotates the rotating link member 250 about its cylindrical post 260 and against the biasing force of the rotational spring 270. When the trip lever 200 is rotated by the pusher arm 190, the rotating link member 250 is thusly rotated about its cylindrical post 260 to the position shown in FIG. 11.

Prior to rotation of the rotating link member 250 (FIG. 9), a radially projecting locking pawl 290 on the rotating link member is seated in a recess 300 of a rotating lock lever 280. The occupation of the locking pawl 290 in the recess 300 prevents the rotating lock lever 280 from rotating in the counterclockwise direction shown in FIG. 9. The rotating lock lever 280 is mounted on a cylindrical post 310 and includes a biasing rotational spring 320 urging the rotation of the lock lever 280 so that the U-shaped catch 305 is projecting upward or "open." With the locking pawl 290 positioned against the lock lever 280, the position of the lock lever and the U-shaped catch 305 cooperate with the parallel plates 15, 16 at the U-shaped mouth 18 to capture a striker pin 23. The striker pin 23 is preferably mounted to a lid of the toolbox such that closing the lid of the toolbox causes the striker pin 23 to move into the mouth 18 of the parallel plates 15, 16. The downward movement of the striker pin 23 further rotates the lock lever 280 against the biasing force of the rotational spring 320 such that the lock lever 280 assumes the position shown in FIG. 9. In this position, the recess 300 is adjacent the locking pawl 290 of the rotating link member 250 and the presence of the locking pawl 290 prevents rotation of the lock lever thus capturing the striker pin between the parallel plates 15, 16 and the U-shaped catch 305 of the lock lever 280. Until the rotating link member 250 and its locking pawl 290 are rotated out of the path of the lock lever 280, the striker pin 23 cannot escape the trap formed by the cooperating parallel plates 15, 16 and lock lever 280, retaining the lid of the toolbox in the closed position. This effectively locks the toolbox closed.

The toolbox is opened through the rotation of the rotating link member 250 through the trip lever 200. As explained above, the actuation of the handle 60 when the pusher arm 190 is in the unlocked position results in a rotation of the trip lever 200 against the drive tooth 240 of the rotating link member 250. The force of the gear tooth 230 on the drive tooth 240 transfers the rotation of the trip lever 200 to the rotating link member 250 as shown in FIGS. 8 and 10. Rotation of the rotating link member 250 causes the locking pawl 290 to evacuate the recess 300 of the lock lever 280. Without the presence of the locking pawl 290 to prevent rotation of the lock lever 280, the biasing spring 320 imparts a rotation of the lock lever 280 in the direction of the arrow 318 in FIG. 10. The rotation of the lock lever 280 releases the striker pin 23 from its trapped configuration between the parallel plates 15,16 and the lock lever 280, permitting the egress of the striker pin 23 and the opening of the toolbox. The rotation of the lock lever 280 resulting from the force of the biasing spring 320 is halted by the presence of a stop tab 340 on plate 15.

The closing of the toolbox lid brings the striker pin downward against the U-shaped catch 305 until it rotates back to the position shown in FIG. 9. As the lock lever 280 rotates and the striker pin 23 is brought into the opening of the mouth 18 of the housing 20, the biasing spring 270 on the rotating link member 250 causes the rotating link member 250 to return to its position shown in FIG. 9 with the locking pawl 290 seated in the recess 300 of the lock lever 280. In this configuration, the latch 10 is once again secure until the turn-key member 140 is rotated to the unlocked position and the handle 60 actuated as described above.

The toolbox rotary latch just described is well suited for a toolbox with a pivoting lid that includes a striker pin traversely deployed on the lid portion of the toolbox for engagement with the latch device. The key that rotates the turn-key member is insertable into the handle from the front of the latch mechanism and permits the toolbox to be latched and locked when the turn-key member is rotated to the locked position described above.

The description of the preferred embodiments are illustrative only and should not be construed as limiting the scope of the invention. One of ordinary skill in the art can deviate from the just-described embodiments without departing from the spirit of the invention. For example, while a pivoting handle is preferred, another handle that pulls out from the housing at each end is also possible. The cooperation of the pusher arm with the turn-key member can take many forms and utilize additional mechanical linkages to alter the direction of the applied force and the direction of the translation and rotation of the various components, while still preserving the essence of the present invention. Thus, the scope of the present invention should not be limited by the descriptions above, but rather the scope of the invention is defined solely by the words of the claims presented below.

What is claimed is:

1. A toolbox latch comprising:

a housing including a face plate and a recessed cavity at a central portion thereof, the recessed cavity including an aperture, a first and second spaced apart parallel brackets substantially parallel to the face plate and rigidly mounted thereto, and first and second cylindrical posts each traversely connected between the first and second spaced apart parallel plates;

a handle in said recessed cavity mounted at a first end on a traversely extending pivot pin, said handle biased into the recessed cavity of the face plate by a return spring member disposed about said pivot pin, said handle further comprising a head at a second end including a rotateable turn-key element concentrically mounted in the handle head and protruding rearwardly from the handle head through the aperture in the face place cavity, the turn-key element further comprising a pusher arm mounted distally to the handle head on said turn-key element, the pusher arm rotating with the turn-key element between a first radial position corresponding to a locked position and a second radial position corresponding to an unlocked position;

a rotary trip lever mounted on the housing to swivel in a plane perpendicular to the face plate, the rotary trip lever comprising a radially protruding leg member operably disposed adjacent the pusher arm when said pusher arm is in the second radial position corresponding to the unlocked position, and further comprising a gear tooth spaced from said leg member whereby rotation of said leg member by engagement with the pusher arm rotates the gear tooth in said plane;

a rotating link member mounted on the first cylindrical post between said first and second parallel plates for rotational movement in a plane parallel to the first and second plates, the rotating link member biased rotationally in a lock position by a first biasing spring member on the first cylindrical post, the rotating link member comprising a drive tooth cooperating with the gear tooth of the rotary trip lever to rotate the rotary link member against the biasing spring to an open position, the rotating link member further comprising a radially projecting locking tooth; and a rotating lock lever mounted on the second cylindrical post between said first and second parallel plates for rotational movement in the plane parallel to the first and second plates, the rotating lock lever comprising a U-shaped latch catch cooperating with the housing to form a trap in a lock position, and opening away from the housing to release the trap in an unlocked position, the rotating lock lever biased in the unlocked position by a second biasing spring member on the second cylindrical post, and further comprising a notch sized to receive the locking tooth of the rotating link member and positioned to engage the locking tooth and prevent rotation of the rotating lock member when the rotary link member is in the lock position.

2. A toolbox latch device comprising:

a housing comprising a face plate with a cavity for housing a pivoting handle therein, and a pair of parallel plates sandwiching a rotating locking lever therebetween, each parallel plate including a portion of an upper surface comprising a U-shaped mouth for receiving a striker pin therein from above;

a handle mounted in said cavity of the housing at a first end on a pivot pin for pivotable movement thereon, said handle further comprising a turn-key member cooperating with a key for rotation displacement of said turn-key member within said handle from an unlocked position to a locked position, said turn-key member extending from said handle through an aperture in said housing at said cavity;

a pusher arm linked to said turn-key member and rotating between an unlocked position and a locked position corresponding to the unlocked position and locked position of the turn-key member, respectively, and wherein the pivoting of said handle about said pivot pin corresponds to a translation of the pusher arm in the direction of the translation of a free end of the handle;

a swiveling trip lever mounted on said housing and at least partially disposed within the path of the pusher arm when the pusher arm is rotated in the unlocked position such that translation of the pusher arm in the unlocked position as a result of the pivoting of the handle causes the pusher arm to rotate the swiveling trip lever, and where the swiveling trip lever further comprises a radially projecting gear tooth that rotates therewith;

a rotating link member disposed in said housing between said parallel plates and mounted on a cylindrical post for rotational motion thereon, said rotating link member biased in a rotational direction by a spring mounted on said cylindrical post, the rotating link member further comprising a drive tooth peripherally located adjacent said gear tooth of the swiveling trip lever whereupon rotation of the swiveling trip lever is transferred to the rotation link member through the cooperation of the gear tooth and the drive tooth, and the rotating link member further comprising a locking pawl projecting radially outward; and a rotating lock lever disposed between the parallel plates and adjacent the rotating link member including a recess at an outer periphery aligned with the locking pawl for cooperation to resist rotation of the lock lever, the lock lever including a U-shaped latch catch cooperating with the U-shaped mouth of the parallel plates to trap a striker pin therein, and further comprising a rotational spring biasing the rotating lock lever against the locking pawl, wherein rotation of the rotational link member via the swiveling trip lever evacuates the locking pawl from the recess of the rotating lock lever allowing the rotational spring to rotate the U-shaped latch catch away from the U-shaped mouth of the housing to permit egress of the striker pin trapped therebetween.

* * * * *